US008510767B2

(12) United States Patent
Weinblatt

(10) Patent No.: US 8,510,767 B2
(45) Date of Patent: Aug. 13, 2013

(54) SYSTEM AND METHOD FOR MONITORING BROADCAST TRANSMISSIONS OF COMMERCIALS

(76) Inventor: Lee S. Weinblatt, Teaneck, NJ (US)

( * ) Notice: Subject to any disclaimer, the term of this patent is extended or adjusted under 35 U.S.C. 154(b) by 883 days.

(21) Appl. No.: 12/079,678

(22) Filed: Mar. 28, 2008

(65) Prior Publication Data

US 2009/0249382 A1 Oct. 1, 2009

(51) Int. Cl.
*H04H 60/56* (2008.01)

(52) U.S. Cl.
USPC ..... 725/12; 725/9; 725/10; 725/11; 725/14; 725/15; 725/16; 725/18

(58) Field of Classification Search
USPC ..... 725/9–22
See application file for complete search history.

(56) References Cited

U.S. PATENT DOCUMENTS

| | | | | |
|---|---|---|---|---|
| 5,630,203 | A * | 5/1997 | Weinblatt | 455/2.01 |
| 2004/0025176 | A1 * | 2/2004 | Franklin et al. | 725/22 |
| 2007/0220544 | A1 | 9/2007 | Nash-Putnam | |

* cited by examiner

*Primary Examiner* — Nicholas Corbo
(74) *Attorney, Agent, or Firm* — Cozen O'Connor

(57) ABSTRACT

A technique for determining whether a program transmitted in a programming signal by a signal source was perceived by audience members within a specified time period. The programming signal is combined with a code signal to form a broadcast signal, wherein occurrence of the code signal corresponds to an occurrence of the program, and wherein the code identifies the program. The broadcast signal is monitored at a central processing facility and each received code is stored with an adjacent segment of the programming signal to create a master data base. Using a device located in the vicinity of an audience member, code signals corresponding to a program as it is being performed by program reproduction equipment and perceived by the audience member are monitored, and each code signal is stored with its said adjacent segment of the programming signal to create audience monitoring data. Based on the master data base and the audience monitoring data, determining whether the audience member perceived the program within a specified time period.

16 Claims, 4 Drawing Sheets

SYSTEM AND METHOD FOR MONITORING BROADCAST TRANSMISSIONS OF COMMERCIALS

TECHNICAL FIELD OF THE INVENTION

The invention relates generally to surveying techniques used while an audience is tuned to a signal broadcast by a television or radio station, and more particularly to a system and method for monitoring broadcast transmissions of commercials.

BACKGROUND OF THE INVENTION

A program is broadcast by a program provider to audience members (persons referred to hereinafter as "viewers" or "participants"). The "program" can be audio and/or video, commercial (e.g. advertisement) and/or non-commercial (e.g. a TV show), and is obtained as a programming signal (e.g. a television signal) from a program signal source (e.g. a television station) originated by a program provider (e.g. an advertiser). The "broadcast" of the program can be over the airwaves, cable, satellite, or any other signal transmission medium. An "audience" for such program reproduction is constituted of the viewers who perceive the program.

The program is "performed" by any reproduction equipment which results in some form of output that is perceptible to human beings, the most common being video and audio. The "reproduction equipment" is any and all types of units to convert a broadcast signal into human perceptible form. The audience can be described as being "tuned" to a program when the signal source is a TV or radio broadcast station.

Advertisers who choose to broadcast their commercials develop a marketing strategy which includes, for example, selection of certain marketing areas, the media (e.g. radio, television, cable, satellite) to advertise in for those marketing areas, the stations to use, how frequently to place the advertisements, and at what time of day. The advertising costs are affected by each of these selections.

Once the marketing strategy has been decided upon and is in the process of being implemented, the advertisers are interested in knowing if their commercials have been broadcast to the viewing or listening public in accordance with the schedule contracted for with the television station, for example. Thus, if the advertiser paid for 10 broadcasts of his commercial he wishes to insure that all 10 were in fact broadcast. Likewise, if the advertiser paid for the 10 broadcasts of his commercial to occur on Sunday, he wishes to insure that all 10 were in fact broadcast on Sunday. Similarly, if the advertiser paid for at least some of the broadcasts of his commercial to be in prime time, he wishes to make sure that none were shown in the early morning hours when viewership is considerably lower.

With some marketing strategies, advertisers chose to have their commercials broadcast on different radio and television stations at overlapping times. This is done to increase the likelihood that their commercials will be seen or heard by as many people as possible at any given time, even if channel switching occurs. With the use of this advertising tactic, it is important for advertisers to know on which stations at any given time their commercial was being viewed or listened to the most and, conversely, on which stations at any given time their commercial was being viewed or listened to the least. With such information the advertiser can fine-tune the marketing strategy to drop those stations which are not cost-effective.

Further, advertisers also typically want to know if their time-sensitive commercials are being viewed or listened to before a critical deadline. For example, a bookstore owner pays for a series of commercials that advertise a famous author will be signing books on a particular date at a particular time. The advertiser would like to know if the commercials are being seen (or heard) by the public before the event, rather than afterwards, as would be the case when a person sees the commercial time-shifted on a recording device, such as a VCR.

SUMMARY OF THE INVENTION

One object of the invention is to provide an improved technique for determining whether commercials are being broadcast to the viewing or listening public in accordance with a specified schedule.

Another object of the invention is to provide an improved technique for determining whether a broadcast commercial was perceived by audience members within a time period of interest to the advertiser.

These and other objects are attained in accordance with one aspect of the present invention directed to a technique for determining whether a program transmitted in a programming signal by a signal source was perceived by audience members within a specified time period. The programming signal is combined with a code signal to form a broadcast signal, wherein occurrence of the code signal corresponds to an occurrence of the program, and wherein the code identifies the program. The broadcast signal is monitored at a central processing facility and each received code is stored with an adjacent segment of the programming signal to create a master data base. Using a device located in the vicinity of an audience member, code signals corresponding to a program as it is being performed by program reproduction equipment and perceived by the audience member are monitored, and each code signal is stored with its said adjacent segment of the programming signal to create audience monitoring data. Based on the master data base and the audience monitoring data, determining whether the audience member perceived the program within a specified time period.

DETAILED DESCRIPTION OF THE DRAWINGS

Figure 1:
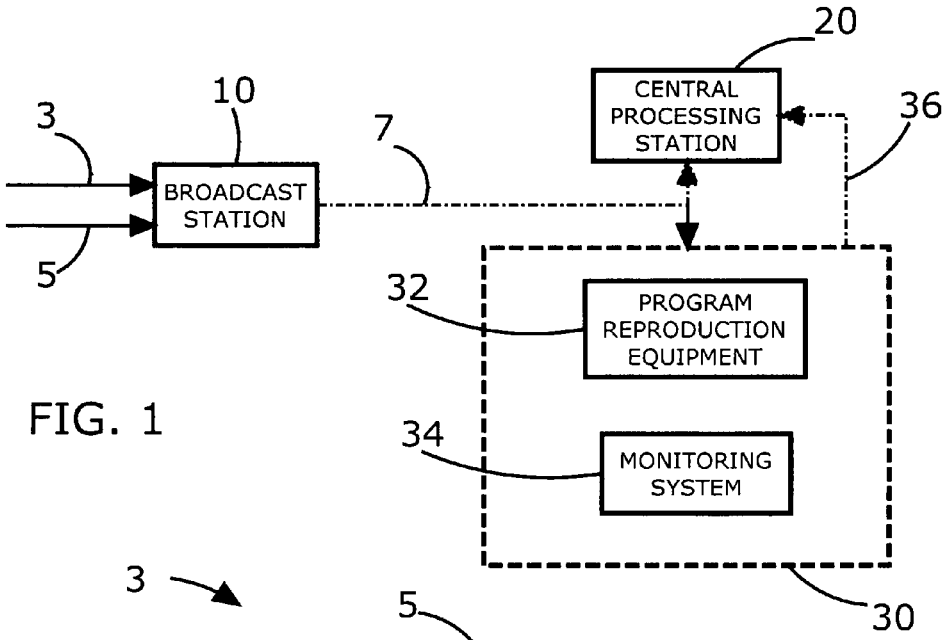
FIG. 1 is an illustrative block diagram of one embodiment of the invention.

In the disclosed embodiment, the invention involves the three main components 10, 20 and 30 shown in FIG. 1. Component 10 is the broadcast station, component 20 is a central processing facility, and component 30 is typically located at the home of a viewer who is a participant in this monitoring operation.

The inputs to broadcast station 10 are programming signal 3 and survey code signal (sometimes referred to herein just as a "code") 5. The programming signal 3 contains all the signals for the program being broadcast, i.e. the commercial portions (e.g. advertisement) and/or non-commercial portions (e.g. a TV show). The programming signal 3 is combined (or encoded) with code 5 to form broadcast signal 7. The code 5 is selected and inserted into programming signal 3 is such a way (as explained below) so as to uniquely identify selected portions of the programming signal. For example, each commercial portion (referred to hereafter for convenience by "commercial") is assigned its own code which, for example, precedes the portion of the programming signal that contains the signal for the commercial. As explained in more detail below, this makes it possible for monitoring equipment to identify which commercial has been broadcast. The encoding of signals for this purpose is well known and is disclosed, for example, in U.S. Pat. Nos. 4,718,106, 5,457,807, 5,630,203, and 7,155,159, the pertinent contents of all off which are hereby incorporated by reference.

Central processing facility 20 automatically and continuously monitors the transmissions of all stations in which the commercial is scheduled to be broadcast in accordance with a specified schedule. The schedule can be specified, for example, in a contract agreed to by the advertiser and the broadcasting station. Thus, central processing facility 20 includes the appropriate circuitry for detecting, demodulating, and processing the received broadcast signal 7. Central processing facility 20 also includes circuitry to detect code 5 and to identify it as the code of interest in accordance with the particular commercial being monitored. Such circuitry is well known and readily implemented by anyone with ordinary skill in the art and, thus, additional details are unnecessary and would unduly burden this description.

One task of central processing facility 20 is to create a Master Database of all the data it detects as a result of its continuous monitoring of the transmissions of all stations within its range in which the commercial is scheduled to be broadcast in accordance with the specified schedule. Details of this Master Database, how it is derived and how it is used are provided below.

Although it is possible to store all of the received broadcast signal for the processing that is required for purposes of this invention, as explained below, the storage capacity utilized for so much data would be mostly wasted because only a very small portion of it is required for purposes of the present invention. Consequently, the disclosed embodiment of the invention proceeds as follows.

Figure 2:
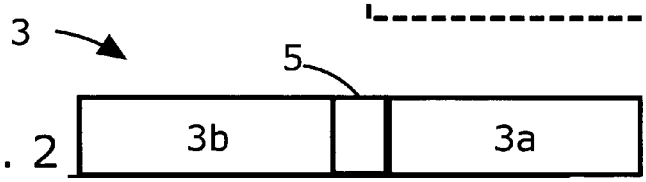
FIG. 2 illustrates a portion of a received broadcast signal, according to one embodiment of the invention.

FIG. 2 illustratively depicts a portion of broadcast signal 7 that includes code 5 which, for example, immediately precedes a portion (also referred to herein as a segment) 3*a* of programming signal 3. Code 5 is associated with a commercial 3*b* in programming signal 3 in terms of frequency of occurrence and timing. For example, code 5 comes immediately after commercial 3*b*, and each occurrence of code 5 corresponds to an occurrence of the commercial to which it is assigned. The timing of code 5 is such that it preferably occurs very close to the commercial. The placement of code 5 within the programming signal 3 is done so that the portion 3*a* which immediately follows each code 5 is different in order to create unique combinations of code 5/portion 3*a*. If commercial 3*b* and code 5 were stored together for each occurrence of code 5, they would not create a unique combination because both are the same for each occurrence. However, the likelihood is that segment 3*a* will be different for each occurrence of code 5, so the combination of code 5 and segment 3*a* is likely to be unique. In order to increase somewhat the likelihood of creating a unique combination, a preset fixed time period could be applied between code 5 and a segment 3*a* to be stored therewith so that they are adjacent to each other, but not immediately adjacent. In order to further increase the likelihood of creating a unique combination, an arbitrarily variable time period could be effected in a well known way and applied between code 5 and a segment 3*a* to be stored therewith. The code 5 can be augmented at the broadcasting end by one or more bytes that include information on the selected time period so it can be processed at the receiving end (i.e. central processing facility 20 and monitoring system 34) in order to identify segment 3*a*. Thus, code 5 is used to indicate, for example, each occurrence of a transmission of a commercial by the broadcast station, and also to create a unique combination of code 5/portion 3*a*

Figure 3:
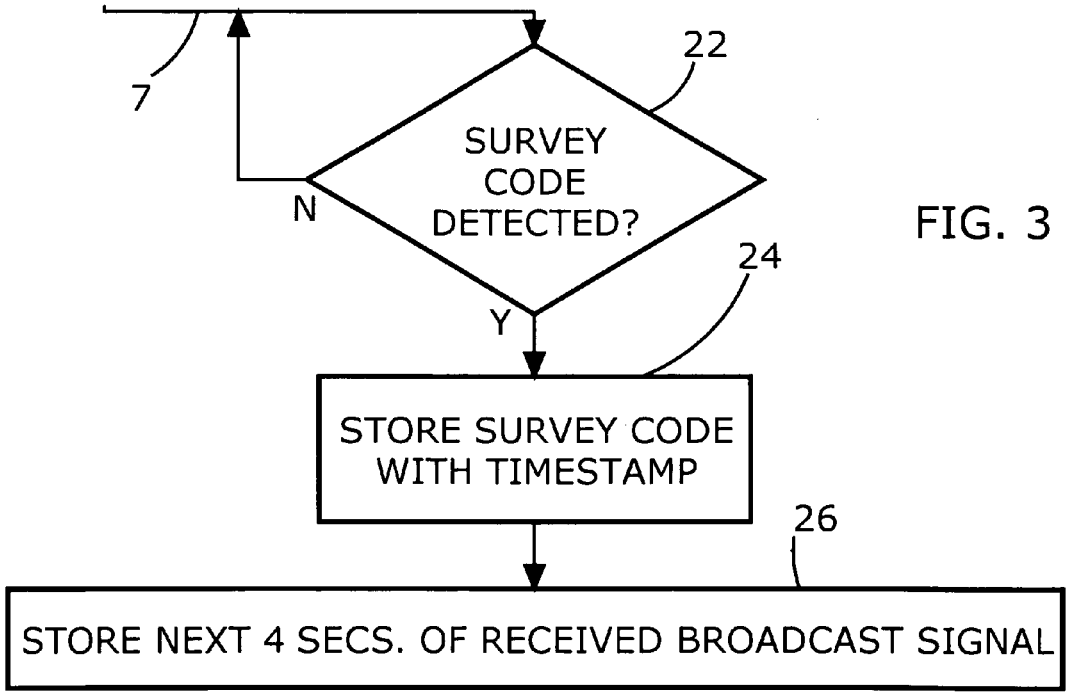
FIG. 3 is an illustrative flow diagram of operations performed by a monitoring system according to one embodiment of the invention for the signal of FIG. 2.

In accordance with FIG. 3, when code 5 is detected, per operation 22, it is stored, per operation 24. Central processing facility 20 also stores, per operation 26, the next 4 seconds of the broadcast signal 7, namely programming signal 3. None of broadcast signal 7 is stored until central processing facility 20 detects and identifies code 5 as the code of interest in this particular monitoring operation. Thus, the result is sought, and achieved, of detecting, identifying and storing the code 5 of interest, and of storing together with it an adjacent portion 3*a* of programming signal 3 that follows it.

In one embodiment of the invention, as explained below, it is useful to know the time of day when the code 5 was detected. Accordingly, central processing facility 20 timestamps the code 5 as part of operation 24. So, as is now readily apparent, the Master Database includes the time stamped code 5 of interest, and together with it an adjacent portion 3*a* of programming signal 3 that follows it.

Figure 4:
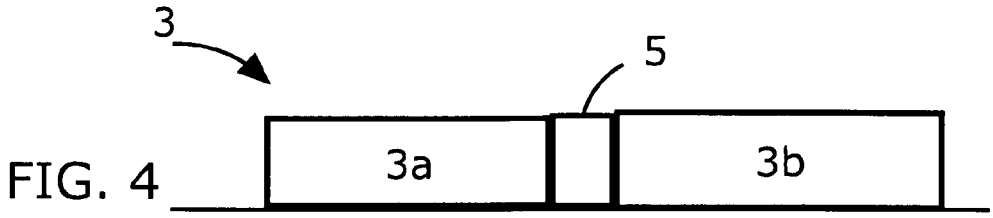
FIG. 4 illustrates a portion of a received broadcast signal, according to another embodiment of the invention.
Figure 5:
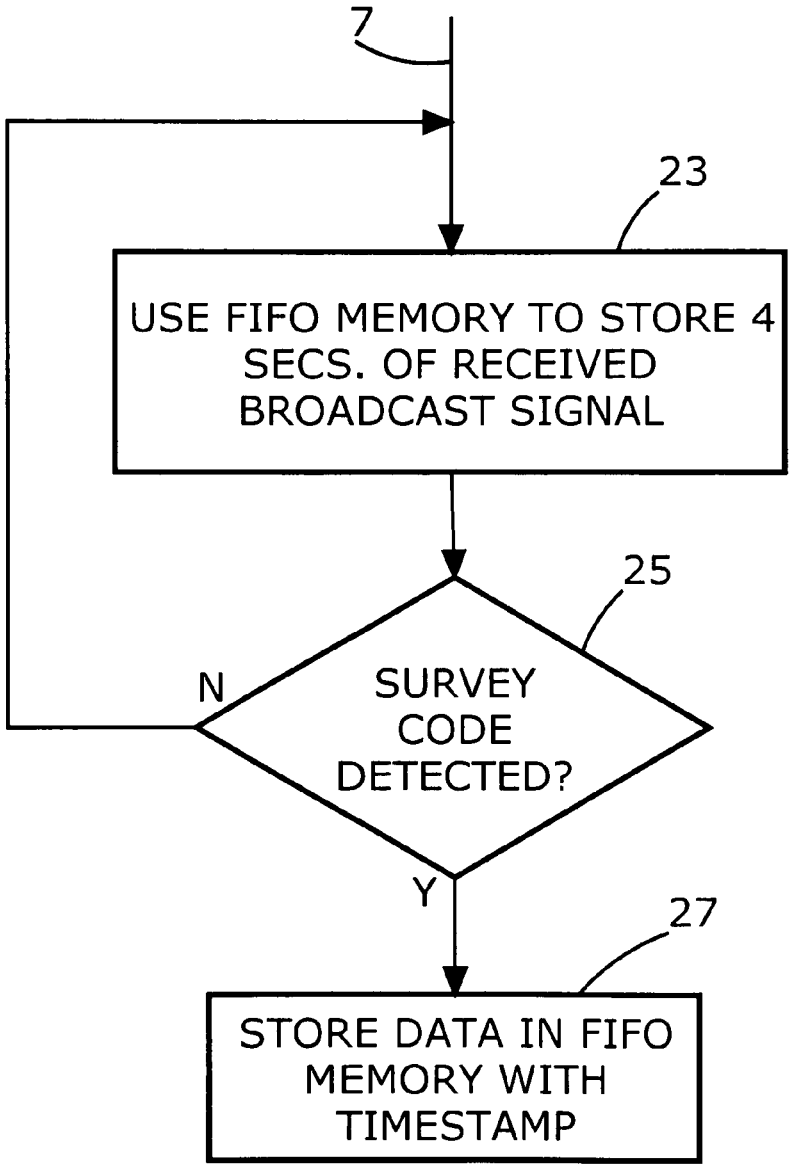
FIG. 5 is an illustrative flow diagram of operations performed by a monitoring system according to another embodiment of the invention for the signal of FIG. 4.

FIGS. 4 and 5 depict another embodiment of the invention. FIG. 4 illustratively depicts a portion of broadcast signal 7 which includes code 5 immediately succeeding a portion 3*a* of programming signal 3. Code 5 is associated with commercial 3*b* which, for example, comes immediately after code 5. In accordance with operation 23 of FIG. 5, a FIFO (first in first out) memory (not shown) is used to constantly retain a 4 second portion of the received broadcast signal 7. When code 5 is detected per operation 25, the data then contained in the FIFO memory is stored, per operation 27. Thus, central processing facility 20 stores in the Master Database, per operation 27, the detected code 5 with the 4 seconds of the portion 3*a* of programming signal 3 that immediately precedes it. Accordingly, as a 4 second portion of received broadcast signal 7 is cycling through the FIFO memory, nothing is permanently stored until central processing facility 20 detects and identifies code 5. As disclosed for the embodiment of FIG. 2, the embodiment of FIG. 4 can also have variations pertaining to a fixed time or a variable time between segment 3*a* and code 5.

Component 30 depicted in FIG. 1 is typically located at the home of a viewer who is a participant in this monitoring operation. Component 30 receives the broadcast signal 7 and separates it into programming signal 3 and code 5. Programming signal 3 is "performed" by program reproduction equipment 32 which produces some form of output that is perceptible to human beings, the most common being video and audio. The survey code signal 5 is inputted to monitoring system 34 which also determines that the participant is in close proximity to program reproduction equipment 32 (e.g. in the same room) and, therefore, is presumed to perceive the program. The above-mentioned U.S. Pat. Nos. 4,718,106, 5,457,807, 5,630,203, and 7,155,159 which have been incorporated hereinto by reference disclose monitoring systems that rely on such a code combined with the programming signal. For example, in one embodiment, the received code 5 is re-transmitted to portable units worn by the survey participants in close proximity to program reproduction equipment 32, and it is stored in the portable units. The portable units can also store a timestamp for the received code 5. It is also possible for monitoring system 34 to have a stationary unit cooperating with portable units. The stationary unit detects the code 5 and identification codes emitted from the portable units in close proximity to program reproduction equipment 32, and it includes memory to store these signals.

As an enhancement to the above-described, known techniques, in accordance with an embodiment of the present invention, the monitoring system 34 will also store a portion of the received broadcast signal 7 which is adjacent to the detected code. Thus, the monitoring system 34 will operate in the same way as the central processing facility 20 in this respect. More specifically, for the embodiment illustrated in FIGS. 2 and 3, the monitoring system 34 will also store the 4 seconds of an adjacent received broadcast signal subsequent to the code. Similarly, for the embodiment illustrated in FIGS. 4 and 5, the monitoring system 34 will also store an adjacent received broadcast signal preceding the code. Of course, in order to do so the monitoring system 34 must include suitable memory and signal detection components. Thus, monitoring system 34 creates audience monitoring data which includes code 5, and adjacent segment 3*a*, and preferably a timestamp.

The audience monitoring data stored in the portable units is periodically uploaded to the central processing facility 20, as represented by signal 36, in any well-known manner. For example, the portable unit can be placed nightly in a cradle and the uploading can be performed automatically over the phone lines or wirelessly. It is also possible to use the Internet for this purpose.

Figure 6:
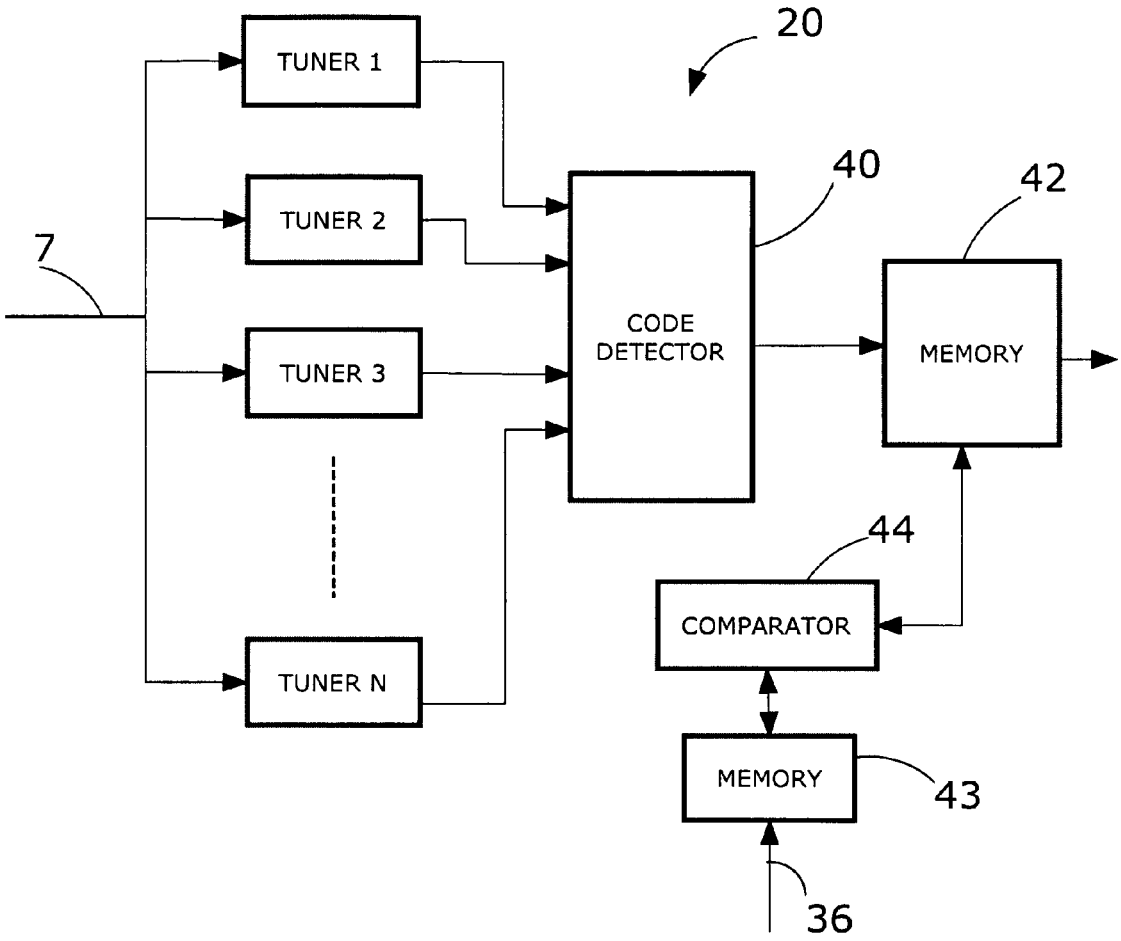
FIG. 6 is a block diagram showing details of a central processing station according to an embodiment of the invention.

FIG. 6 shows details of central processing facility 20. A plurality of tuners TUNER 1, TUNER 2 . . . TUNER N are each tuned to a different selected station. Thus, for example, TUNER 1 is tuned to AM radio station A, TUNER 2 is tuned to FM radio station B, TUNER 3 is tuned to TV station C, and so on. Each station is one with which the advertiser has contracted to broadcast the commercial, which is audio and/or video. A sufficient number N of tuners is provided to have full coverage for each and every station contracted within the area served by the particular central processing facility.

Code detector 40 receives the output signals from all the tuners and processes them to detect a survey code 5 of interest to the advertiser. The survey code 5 is unique to a particular commercial, for example. When a survey code is detected, that detection is indicative of the fact that the particular station on the output of which the code was detected actually broadcast the commercial. When such a code is detected, the following data associated therewith is stored in memory 42: the code, identity of the tuner (and therefore the station) from which the code was received, the timestamp, and a 4 second segment from the immediately adjacent programming signal data.

Verification of the commercial being broadcast as per the specified schedule can now be made by reading the data stored in memory 42. With the requisite data being stored in memory 42, how this can be done is self-evident because the actual occurrences are determined from the stored instances of code 5. Such occurrences can then be readily compared with the specified schedule to identify any discrepancies.

Figure 7:
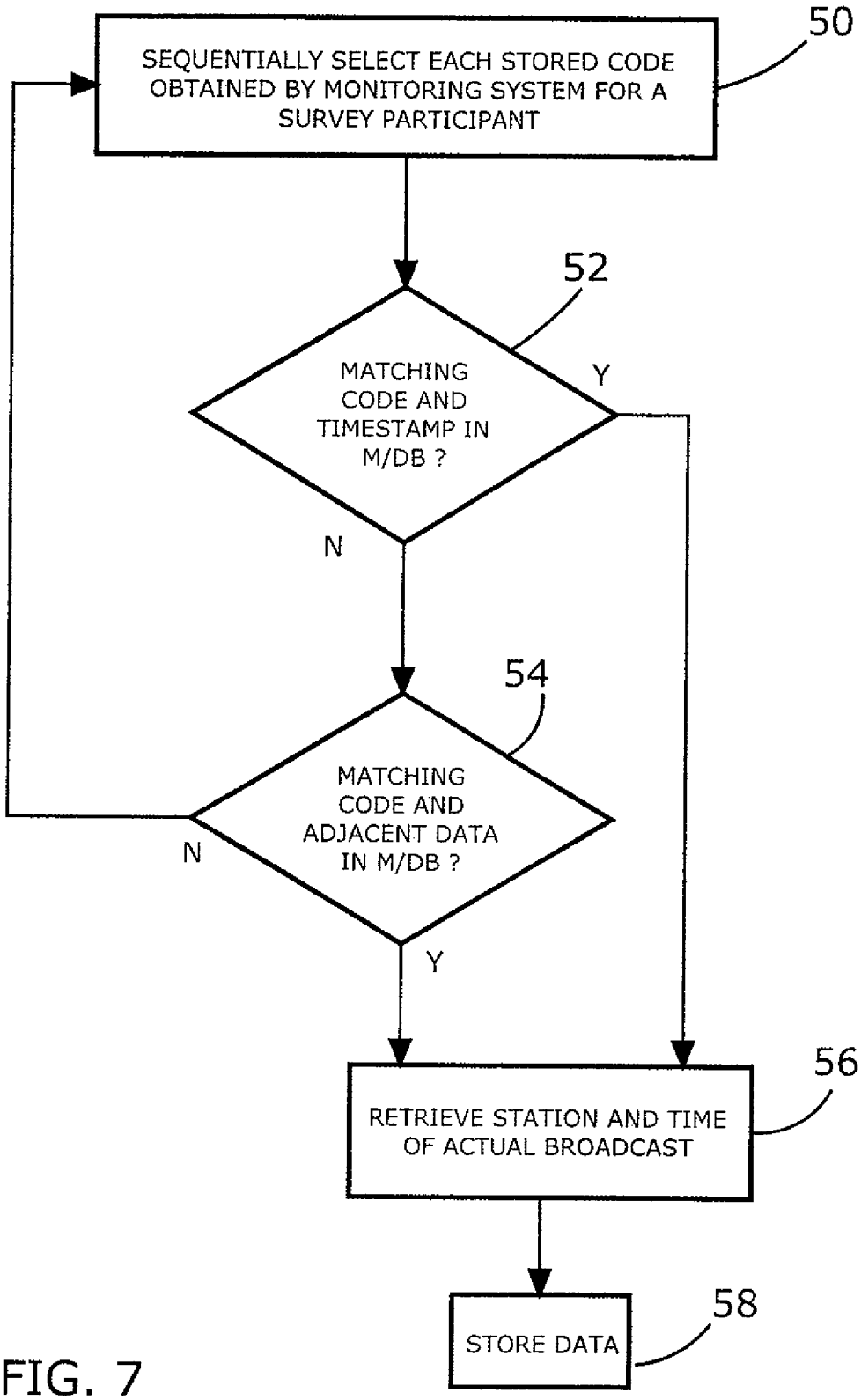
FIG. 7 is an illustrative flow chart of operations performed by the central processing station of FIG. 6.

It is also possible in accordance with the present invention to determine whether the commercial, which may have been recorded for later viewing, was perceived by the audience members within the time period of interest to the advertiser. Comparator 44 serves this purpose by comparing data stored in memory 42 with data received in signal 36 (see FIG. 1) from the monitoring system 34. As per FIG. 7, which depicts functions performed by comparator 44, operation 50 selects the first code detected by the monitoring system 34 for a particular survey participant. Per operation 52, this code is checked for a match in the Master Database (("M/DB") stored in memory 42. If a match is found, then the timestamp of both codes is checked. If they are substantially identical, then this means that the participant perceived this commercial in real time. In operation 56 the station is identified, and then all of this data (i.e. station, code, time of broadcast, time perceived) are stored in memory 42, per operation 58.

If operation 52 does not find a match for the code and its timestamp, then operation 54 looks for a match for the code and its adjacent data. It should be understood that, by itself, the selected code 5 being operated on from operation 50 can have numerous matches in the M/DB if its timestamp does not have a match because although a code is unique to a commercial, the commercial may have been broadcast several times that day, as explained above, pursuant to marketing strategy. The selected code will have a match in the M/DB for each of the corresponding broadcast commercials. To which one of these codes in the M/DB does the selected code correspond? Stated more specifically, assume the participant watched the taped commercial at 9:30 p.m. on a VCR, and this was stored by monitoring system 34. That day, this commercial was broadcast at 8:05 a.m., 1:23 p.m., and 5:48 p.m. How can the system know whether the code detected by the monitoring system 34 at 9:30 pm corresponds to the actual broadcast that occurred at 8:05 a.m., or at 1:23 p.m., or at 5:48 p.m. that day? Moreover, this becomes more complicated when the commercial is simultaneously broadcast on multiple channels that day. To which broadcast of the commercial in terms of time and station does the selected code from signal 36 correspond? Such information regarding the time shift and the broadcast station can be valuable to an advertiser for making adjustments in how to devise and/or revise the marketing strategy.

This information is provided by operation 54 which is based on the well-founded presumption that each combination of code and adjacent data is unique. Thus, when operation 54 finds a match in the M/DB for such a combination, that matching data in the M/DB is taken to include the time at which the actual broadcast occurred, and the station in that matching data is taken to be the actual broadcasting station. The resulting information derived by operation 56 is stored in memory 42 per operation 58.

With the information thus collected, it is possible to accurately determine when the participant perceived the particular commercial that was broadcast at a particular time so that the advertiser knows whether the participant perceived that commercial within the desired time.

Although preferred embodiments of the invention have been disclosed above in detail, various modifications thereto will readily occur to anyone with ordinary skill in the art. For example, the 4 second duration of the programming signal adjacent to code 5 can be longer or shorter depending on specific design considerations. These and all such modifications are intended to fall within the scope of the present invention as defined by the following claims.

I claim:

1. A method for determining whether a program transmitted in a programming signal by a signal source was perceived by audience members within a specified time period, comprising the steps of:

combining the programming signal with a code signal to form a broadcast signal, wherein occurrence of the code signal corresponds to an occurrence of the program, and wherein the code signal identifies the program;

monitoring the broadcast signal at a central processing facility and storing each occurrence of the received code signal with an adjacent segment of the programming signal to create a master data base;

monitoring, with a device in the vicinity of an audience member, the code signal corresponding to the program as it is being performed by program reproduction equipment and perceived by the audience member, and storing each occurrence of the code signal with its said adjacent segment of the programming signal to create audience monitoring data;

determining from the master data base and the audience monitoring data whether the audience member perceived the program within a specified time period; and storing timestamps in the master data base and the audience monitoring data corresponding to respective occurrences of the code signal stored therein, wherein said determining step comprises finding a match in the master data base and the audience monitoring data for a combination of the code signal and the adjacent segment.

2. The method of claim 1, wherein the program is a commercial.

3. The method of claim 1, wherein each occurrence of the code signal is stored in the master data base and the audience monitoring data with said adjacent segment which comes after it in the broadcast signal.

4. The method of claim 1, wherein each occurrence of the code signal is stored in the master data base and the audience monitoring data with said adjacent segment which comes before it in the broadcast signal.

5. The method of claim 1, wherein each occurrence of the code signal is stored in the master data base and the audience monitoring data with said adjacent segment which is immediately adjacent thereto it in the broadcast signal.

6. The method of claim 1, wherein each occurrence of the code is stored in the master data base and the audience monitoring data with said adjacent segment which is separated therefrom in the broadcast signal by a fixed time period.

7. The method of claim 1, wherein each occurrence of the code signal is stored in the master data base and the audience monitoring data with said adjacent segment which is separated therefrom in the broadcast signal by a variable time period.

8. The method of claim 1, wherein said determining step comprises finding a match in the master data base and the audience monitoring data for a combination of the code signal and the timestamp.

9. A system for determining whether a program transmitted in a programming signal by a signal source was perceived by audience members within a specified time period, comprising:

means for combining the programming signal with a code signal to form a broadcast signal, wherein occurrence of the code signal corresponds to an occurrence of the program, and wherein the code signal identifies the program;

means for monitoring the broadcast signal at a central processing facility and storing each occurrence of the received code with an adjacent segment of the programming signal to create a master data base;

means for monitoring, with a device in the vicinity of an audience member, the code signal corresponding to the program as it is being performed by program reproduction equipment and perceived by the audience member, and storing each occurrence of the code signal with its said adjacent segment of the programming signal to create audience monitoring data;

means for determining from the master data base and the audience monitoring data whether the audience member perceived the program within a specified time period; and means for storing timestamps in the master data base and the audience monitoring data corresponding to respective occurrences of the code signal stored therein, wherein said means for determining comprises means for finding a match in the master data base and the audience monitoring data for a combination of the code signal and the adjacent segment.

10. The system of claim 9, wherein the program is a commercial.

11. The system of claim 9, wherein each occurrence of the code signal is stored in the master data base and the audience monitoring data with said adjacent segment which comes after it in the broadcast signal.

12. The system of claim 9, wherein each occurrence of the code signal is stored in the master data base and the audience monitoring data with said adjacent segment which comes before it in the broadcast signal.

13. The system of claim 9, wherein each occurrence of the code signal is stored in the master data base and the audience monitoring data with said adjacent segment which is immediately adjacent thereto it in the broadcast signal.

14. The system of claim 9, wherein each occurrence of the code signal is stored in the master data base and the audience monitoring data with said adjacent segment which is separated therefrom in the broadcast signal by a fixed time period.

15. The system of claim 9, wherein each occurrence of the code signal is stored in the master data base and the audience monitoring data with said adjacent segment which is separated therefrom in the broadcast signal by a variable time period.

16. The system of claim 9, wherein said means for determining comprises means for finding a match in the master data base and the audience monitoring data for a combination of the code signal and the timestamp.

* * * * *